United States Patent [19]

Frantzreb, Sr. et al.

[11] 4,107,393

[45] Aug. 15, 1978

[54] INOCULATION ARTICLE

[75] Inventors: John G. Frantzreb, Sr.; C. David Weiss, both of Peoria, Ill.

[73] Assignee: Caterpillar Tractor Co., Peoria, Ill.

[21] Appl. No.: 777,387

[22] Filed: Mar. 14, 1977

[51] Int. Cl.[2] ..... B22D 27/18; B32B 15/00; C22C 33/08

[52] U.S. Cl. ..... 428/558; 75/130 R; 164/57; 428/379

[58] Field of Search ..... 428/558, 364, 372, 379, 428/401; 164/57; 75/130 R

[56] References Cited

U.S. PATENT DOCUMENTS

| | | | |
|---|---|---|---|
| 3,056,190 | 10/1962 | Chisholm et al. | 428/558 |
| 3,367,395 | 2/1968 | Karsay | 164/57 |
| 3,921,700 | 11/1975 | Frantzreb, Sr. et al. | 428/558 |

*Primary Examiner*—William R. Dixon, Jr.
*Attorney, Agent, or Firm*—Charles E. Lanchantin, Jr.

[57] ABSTRACT

An article for insertion into and inoculating molten metal is an elongated steel conduit having ferro-silicon material within the conduit. The ferro-silicon material has a silicon content greater than about 75% by weight and is compacted within the conduit to a magnitude sufficient for increasing the density at least 10% above the tapped density of said material.

4 Claims, 4 Drawing Figures

INOCULATION ARTICLE

BACKGROUND OF THE INVENTION

In the inoculation of molten metal, for example cast iron including ductile iron, compacted graphite iron, malleable iron, and others, preferably gray iron, inoculation materials are sometimes introduced into the molten metal by an encompassing conduit. By providing a conduit having the inoculant therein, the resultant inoculating article is generally in wire form and can conveniently be controllably fed by feeding apparatus into molten metal simultaneously being poured into a mold, as is known in the art.

The heretofore utilized inoculating articles functioned satisfactory in some applications, but, in other situations, performed with less than desirable efficiency. This less than desirable efficiency generally resulted from maximum obtainable feed rates, nonuniformity of inoculant dispersion, melting temperatures of the components of the articles, and other factors.

One of the greatest problems encountered was in inoculating molten metal with preselected inoculating materials while maintaining the temperature of the molten metal at a preselected low value. Owing to the current shortages of energy in the world, it is desirable to maintain the molten metal at a desirably low temperature in order to avoid the waste of energy. At these desirable low temperatures of the molten metal, the specific inoculant desired to be utilized and the conduit sometimes would not melt.

The present invention is directed to overcoming one or more of the problems as set forth above.

According to the present invention, an inoculating article has a steel conduit having inoculating material positioned within the conduit. The inoculating material is ferro-silicon having a silicon content greater than about 75% by weight and the inoculating material is compacted within the conduit.

DETAILED DESCRIPTION OF THE INVENTION

Figure 1:
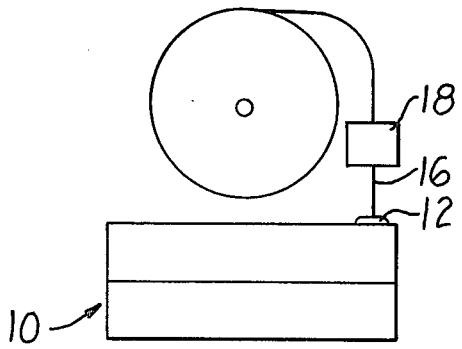
FIG. 1 is a diagrammatic side view of a molding system using the inoculating article or wire of this invention.

Referring to FIG. 1, a mold 10 has a sprue 12 through which molten metal (not shown) is poured and simultaneously an inoculating article 16 in wire form is controllably inserted by feed means 18 into the molten metal stream in the sprue 12, as is known in the art. As the inoculating article 16 passes into the molten metal, the temperature of the article 16 is increased to a temperature sufficient for melting the article 16 and thereby dispersing said inoculating materials, in other than solid form, through the molten metal.

Figure 2:
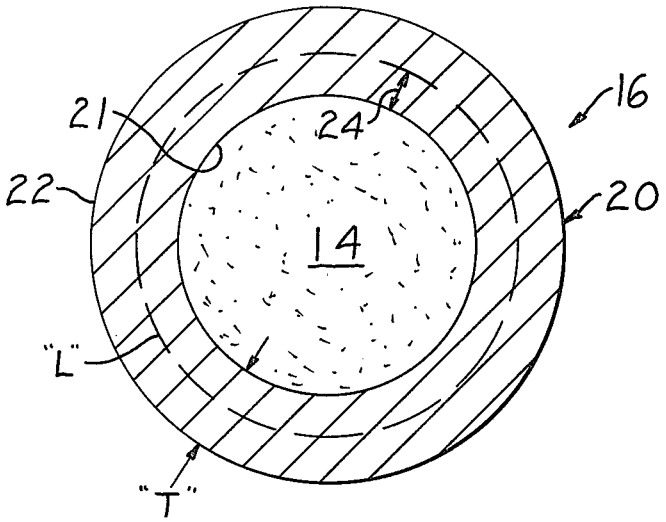
FIG. 2 is a diagrammatic cross sectional view of the inoculating article.

Referring to FIG. 2, the inoculating article 16 of this invention is an elongated steel conduit 20 having an inoculating material 14 positioned within the conduit 20. The inoculating material is ferro-silicon having a silicon content greater than 65% by weight of said material 14 and said material 14 is compacted within the conduit 20 to a magnitude sufficient for increasing the density of said material 14 at least 10% above its tapped density.

It should be understood that by the term "tapped density", as used herein, it is meant the procedure as described in "Handbook of Metal Powders" - Poster, Reinhold Publishing Co. New York, New York, 1966, page 57. It should also be understood that by the term "diffusing", as used herein, it is meant solid state diffusion, as is known in the metallurgical art.

The silicon content of the material 14 is sufficient for diffusing silicon from the material 14 into said conduit to a value sufficient for substantially only lowering of the melting temperature of said material 14 and lowering the melting temperature of a preselected internal portion 24 of the conduit 20 to a preselected temperature. The silicon of the material 14 is diffused in response to heating of the article 16 and said preselected internal portion 24 of the conduit 20 is greater than 30% of the wall thickness "T" of the conduit 20.

The specific construction of the article 16 is of particular importance. If the quantity of silicon is less than 65% and the material 14 is not sufficiently compacted within the conduit 20, the melting temperature of the conduit portion 20 will not be sufficiently lowered and the melting temperature of the material 14 will begin to rise in response to loss of silicon. This results in requiring the temperature of the molten metal to be maintained at a higher value in order to melt the complete article 16 and thereby represents a waste of energy. The rate of article 16 insertion into the mold 10 is also lowered when using an article of less compaction and/or silicon content. This further compounds energy waste.

In order to provide an article which can be inserted and melted at the maximum possible rate and thereby function to conserve energy, it is preferred that the silicon of the material 14 be diffused into the inner surface 21 of the conduit 20 uniformly and to a preselected depth at which melting of the conduit 20 in response to outside carbon diffusion meets melting of the conduit 20 in response to inside silicon diffusion at an annular location, preferably 60% "T" as measured outwardly from the inside surface 21 of the conduit 20 and as shown by broken line "L" in FIG. 2.

Upon insertion into the molten metal of the mold 10, silicon from the material 14 begins diffusing in the metal of the inner surface 21 of the conduit 20 and carbon from the molten metal begins diffusing into the outer surface 22 of the conduit 20.

Figure 3:
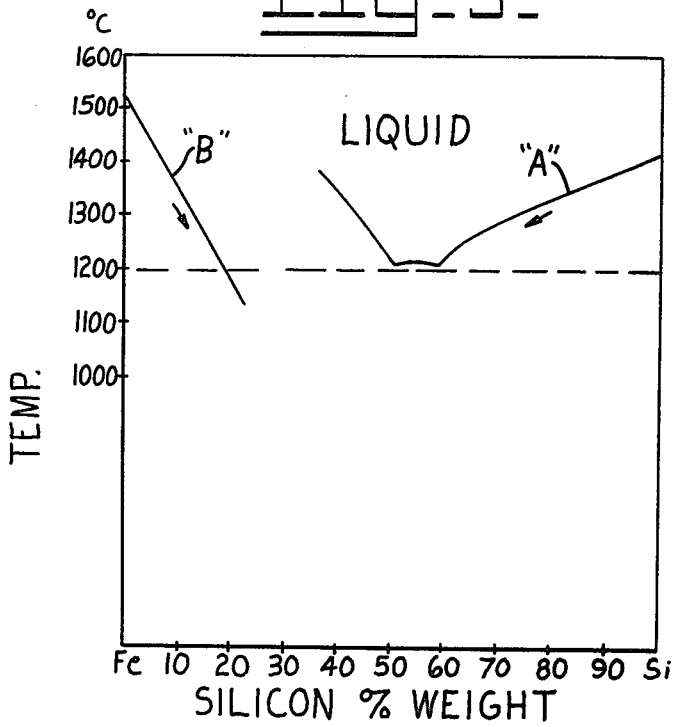
FIG. 3 is an iron-silicon phase diagram of the article.

Referring to FIG. 3, as silicon diffusion from the material 14 continues, the temperature at which said material 14 will melt is progressively lowered in response to giving up silicon to the conduit 20 and follows a known curve "A". As the inside surface 21 of the conduit 20 receives diffused silicon from the material 14, the temperature at which the inside surface 21 of the conduit 20 will melt is also progessively lowered and follows a known curve "B".

A study of the curves "A" and "B" therefore shows that if the article 16 is properly constructed, the temperature of the molten metal can be maintained at a preselected relatively low value and, through silicon diffusion action the inside surface 21 of the conduit 20 and the inoculating material 14 can be caused to melt at temperatures less than the initial melting temperature of either the conduit 20 by itself or the material 14 by itself.

Figure 4:
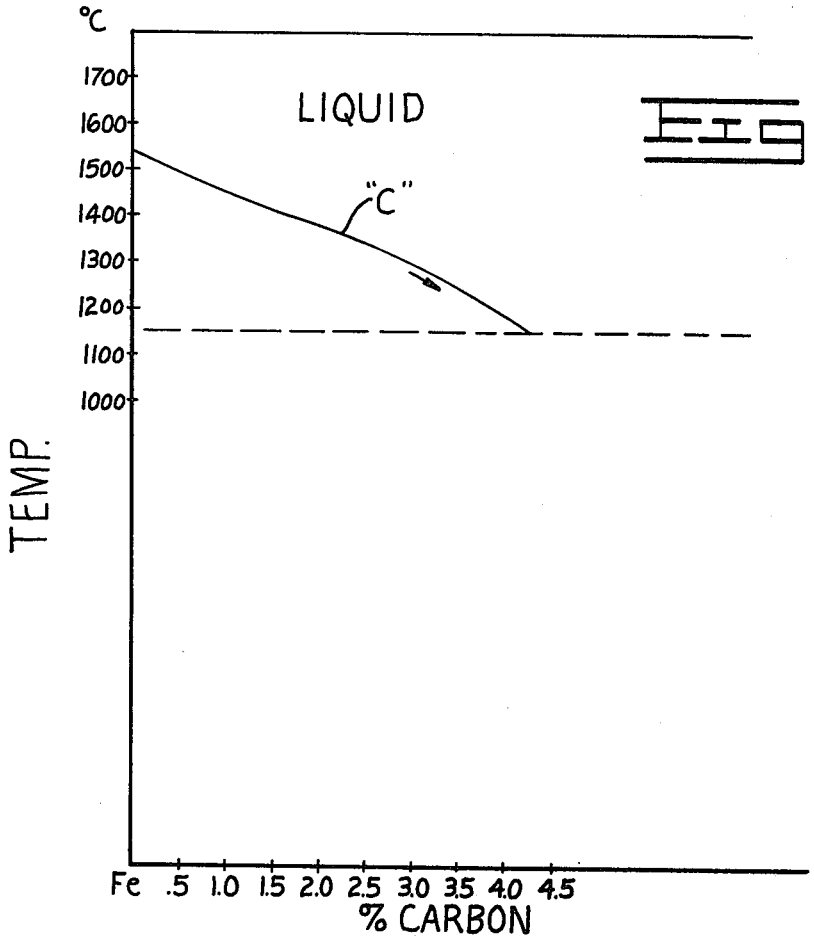
FIG. 4 is an iron-carbon phase diagram of the conduit of this invention.

Referring to FIG. 4, as carbon diffuses from the molten metal into the outside surface 22 of the conduit 20, the temperature at which the outside surface 22 of the conduit 20 will melt is progressively lowered in response to receiving carbon from the molten metal and follows a known curve "C".

In a preferred example article, the conduit 20 was formed of AISI C-1010 steel which was a low carbon, mild steel, and a wall thickness of 0.4 mm, and an outside diameter of 3.2 mm. The inoculating material 14 was ferrosilicon containing 75% silicon identified as grade 75% ferrosilicon manufactured by Union Carbide Corporation, Ferroalloys Division, Buffalo, New York. The inoculating material 14 was compacted in the conduit 20 and had a resultant density of about 2.4 gms. of inoculating material 14 per cubic centimeter.

The molten metal was SAE G-3000 gray iron having a pour temperature of 1400° C.

Prior to insertion of the article 16 into the molten metal, the melting point of the conduit 20 was 1538° C and the melting point of the inoculating material 14 was 1300° C.

An end portion of the wire-shaped article 16 was inserted into the molten metal and as the temperature of the article 16 increased the silicon of the material 14 began rapidly diffusing into the inner walls of the conduit 20 and carbon of the molten metal began rapidly diffusing in the outer walls of the conduit 20. As silicon and carbon diffusion continued, the melting point of the material 14 was progressively lowered along curve "A" and the melting point of the conduit 20 was lowered along curves "B" and "C" (FIGS. 3 and 4).

Owing to the controlled sizing of the conduit and the amount of silicon per unit length of the conduit, the melting temperature of the material 14 was lowered to 1208° C in approximately the same length of time that the melting temperature of the conduit reached 1195° C and the conduit was totally melted thereby releasing the melted inoculating material 14 into the mold. The total melting of the conduit occurred at about 60% "T" as measured from the inner surface 21 thereby showing internal melting of the conduit 20 at a greater rate than external melting of the conduit 20.

The wall thickness "T" of the conduit 20, the percentage of silicon in the material 14, and the amount of material 14 per unit length of conduit 20 can easily be calculated by one skilled in the art once he has determined the desired temperature of the molten metal in the mold during inoculation and the desired inoculation rate.

The inoculating material can also contain small portions of one or more trace elements for producing a specific resultant molded product. Trace elements that have been found to be useful in the article 16 include strontium, barium, calcium, aluminum, cerium, and rare earth alloys, among others.

It should be understood, however, that the inoculating material of this invention consists of at least 95.0 weight per cent of the material 14 being ferro-silicon and only 5.0 weight percent or less being the trace materials.

The ferro-silicon utilized is in granular form and the material 14 can contain small amounts of various binders and/or lubricants for ease in fabricating the article 16. The surfaces 21, 22 of the article 16 should be maintained relatively free of foreign materials. The silicon content of the material 14 is preferably about 75% by weight of said material 14.

The material 14 is compacted within the conduit to a magnitude at which the density of the material is increased at least 10% above the tapped density of said material, preferably increased to about 17% above the tapped density. Density increases less than about 10% increase or no compaction at all are undesirable because the conduit 20 will undesirably melt nonuniformly due to nonuniform silicon diffusion. Material 14, if not satisfactorily compacted, might free-fall from the conduit into the molten metal.

It is also desirable to control the wall thickness "T" of the conduit 20 relative to the amount of silicon per unit length of conduit for controllably melting the entire conduit at a preselected rate in response to inserting the article 16 into molten metal having a preselected temperature. By so controlling these dimensions, the inoculation rate can be controlled to avoid the waste of time. This factor also functions to avoid the waste of energy.

By the term "substantially only lowering of the melting temperature of the material", it is meant that the melting temperature of the material as shown on curve "A" does not increase from its lowest melting temperature a value more than 10° C.

Other example inoculating articles 16 and uses of the articles are as follows:

| | Example #1 | Example #2 |
|---|---|---|
| Conduit (20) | | |
| Material | AISI C-1010 | AISI C-1010 |
| Wall Thickness "T" | 0.8 mm | 0.20 mm |
| Outside Diameter | 3.2 mm | 3.2 mm. |
| Material (14) | | |
| Ferro-silicon, silicon content | 90 wt % | 65 wt % |
| Compaction increase (tapped density basis) | 25% | 10% |
| Trace elements: | | |
| Calcium | 0.5 | 0.5 |
| Aluminum | 0.79 | 0.79 |
| Molten Metal - SAE G-3000 Gray Iron | | |
| Pour Temperature | 1454° C | 1288° C |
| Article 16 feed rate | 8.9 cm/sec | 17.8 cm/sec |

In example runs 1 and 2, the feed rates of the article 16 were desirably high, and the resultant casting was free of chilled surfaces, undissolved inoculant, undissolved conduit, and the resultant product was of good quality.

In runs where compaction of the material 14 had less than a 10% increase, as set forth above, or the silicon content was lower than 65%, the feed rate was found to be less than desirable, and the resultant casting had numerous chilled surfaces, contained nonmetallic inclusions, and was generally considered to be of poor quality.

The article 16 can be constructed in wire form by several methods known in the art. Preferably the material 14 is laid down in an uninterrupted generally uniform layer extending along the middle portion of an elongated strip of steel. The strip of steel is thereafter formed around the layer of material 14 with the opposed longitudinally extending edges of the steel abutting one another. The resultant steel conduit having the material 14 contained therein is thereafter subjected to axial forces of a magnitude sufficient to plastically deform the conduit, thereby compacting the material 14 to a preselected density.

The embodiments of the invention in which an exclusive property of privilege is claimed are defined as follows:

1. An inoculating article for treating a molten metal having a preselected temperature, comprising:

an elongated steel conduit having an internal surface, an external surface and a preselected thickness between said surfaces, said conduit having a melting temperature above said preselected temperature of the molten metal; and an inoculating material positioned within said conduit, said material consisting essentially of ferrosilicon having a silicon content greater than about 75% by weight and being compacted within said conduit to at least 10% above the tapped density of said material, said ferro-silicon having a melting temperature below said preselected temperature of the molten metal, said silicon content being sufficient for diffusing silicon from said material into said internal surface of said conduit to a value sufficient for lowering the melting temperature of at least 30% of said preselected thickness of said conduit below said preselected temperature.

2. The article of claim 1 wherein said material is compacted to a magnitude of at least 17% above the tapped density of said material.

3. The article of claim 1 wherein at least 95% by weight of said inoculating material is ferro-silicon with the remainder being trace materials.

4. The article of claim 3, wherein the trace materials are strontium, barium, calcium, aluminum, cerium and rare earth alloys.

* * * * *